US006540168B1

(12) United States Patent
Archer et al.

(10) Patent No.: US 6,540,168 B1
(45) **Date of Patent: *Apr. 1, 2003**

(54) RETRACTABLE CORD ASSEMBLY

(76) Inventors: Dorian O. Archer, 1349 Apt. B Greenmoss Dr., Richmond, VA (US) 23225; S. Devon Beverly, 7308 Buck Rub Ct., Midlothian, VA (US) 23112

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,244

(22) Filed: Sep. 1, 1999

(51) Int. Cl.[7] ..... B65H 75/38; B65H 75/30

(52) U.S. Cl. ..... 242/388.6; 242/378.2; 242/395.1; 242/397.1; 242/603

(58) Field of Search ..... 242/388.6, 395.1, 242/396.4, 397.1, 603, 378, 378.1, 378.2

(56) References Cited

U.S. PATENT DOCUMENTS

| | | | | | |
|---|---|---|---|---|---|
| 1,918,657 | A | * | 7/1933 | Millar | 242/378 X |
| 1,958,626 | A | * | 5/1934 | Krantz | 242/378.2 X |
| 2,108,111 | A | | 2/1938 | Ehrlich | |
| 2,141,909 | A | * | 12/1938 | Hauser | 242/378.2 |
| 2,428,446 | A | | 10/1947 | Beede | |
| 2,514,628 | A | | 7/1950 | Cortes | |
| 2,719,702 | A | | 10/1955 | Brace | |
| 2,848,731 | A | | 8/1958 | Tamarin | |
| 2,856,470 | A | * | 10/1958 | Hyde | 242/395.1 X |
| 2,949,251 | A | * | 8/1960 | Sparklin | 242/395.1 X |
| 3,695,544 | A | * | 10/1972 | Morey, Sr. | 242/378.2 |
| 4,061,290 | A | * | 12/1977 | Harrill | 242/395.1 X |
| 4,141,438 | A | | 2/1979 | Diem | |
| 4,150,798 | A | | 4/1979 | Aragon | |
| 4,340,192 | A | | 7/1982 | Burris, III | |
| 4,386,621 | A | * | 6/1983 | Redl | 242/388.6 X |
| 4,517,757 | A | | 5/1985 | Asada et al. | |
| 4,557,430 | A | * | 12/1985 | Bonhard | 242/395.1 X |
| 4,748,755 | A | * | 6/1988 | Bain, Jr. et al. | 38/88 |
| 5,025,578 | A | * | 6/1991 | Firatli et al. | 38/93 |
| 5,371,960 | A | | 12/1994 | Wilson et al. | |
| 5,853,136 | A | * | 12/1998 | Lai | 242/396.4 X |
| 6,015,110 | A | * | 1/2000 | Lai | 242/396.4 X |
| 6,019,304 | A | | 1/2000 | Skowronski et al. | |

FOREIGN PATENT DOCUMENTS

| | | | | |
|---|---|---|---|---|
| CH | 626860 | * | 12/1981 | 242/405.2 X |
| DE | 27 45 739 | | 6/1978 | |
| DE | 28 37 467 | | 3/1980 | |
| DE | 37 21 044 | * | 1/1989 | 242/388.6 X |
| GB | 274018 | | 10/1926 | |
| GB | 1206683 | | 9/1970 | |
| JP | 48-28080 | | 8/1973 | |

* cited by examiner

*Primary Examiner*—Kathy Matecki
*Assistant Examiner*—Minh-Chau Pham

(57) ABSTRACT

A retractable power cord assembly, which may be incorporated into the rear cover of a steam iron, has two cord-receiving cavity sections. To increase the capacity of the assembly, the first section is so narrow that turns of the power cord wound into the first section are confined to be wrapped one on top of the other whereas the second section is sufficiently wide that the turns accumulate more randomly within the second section. A hand crank is pivotally mounted on the assembly housing.

11 Claims, 6 Drawing Sheets

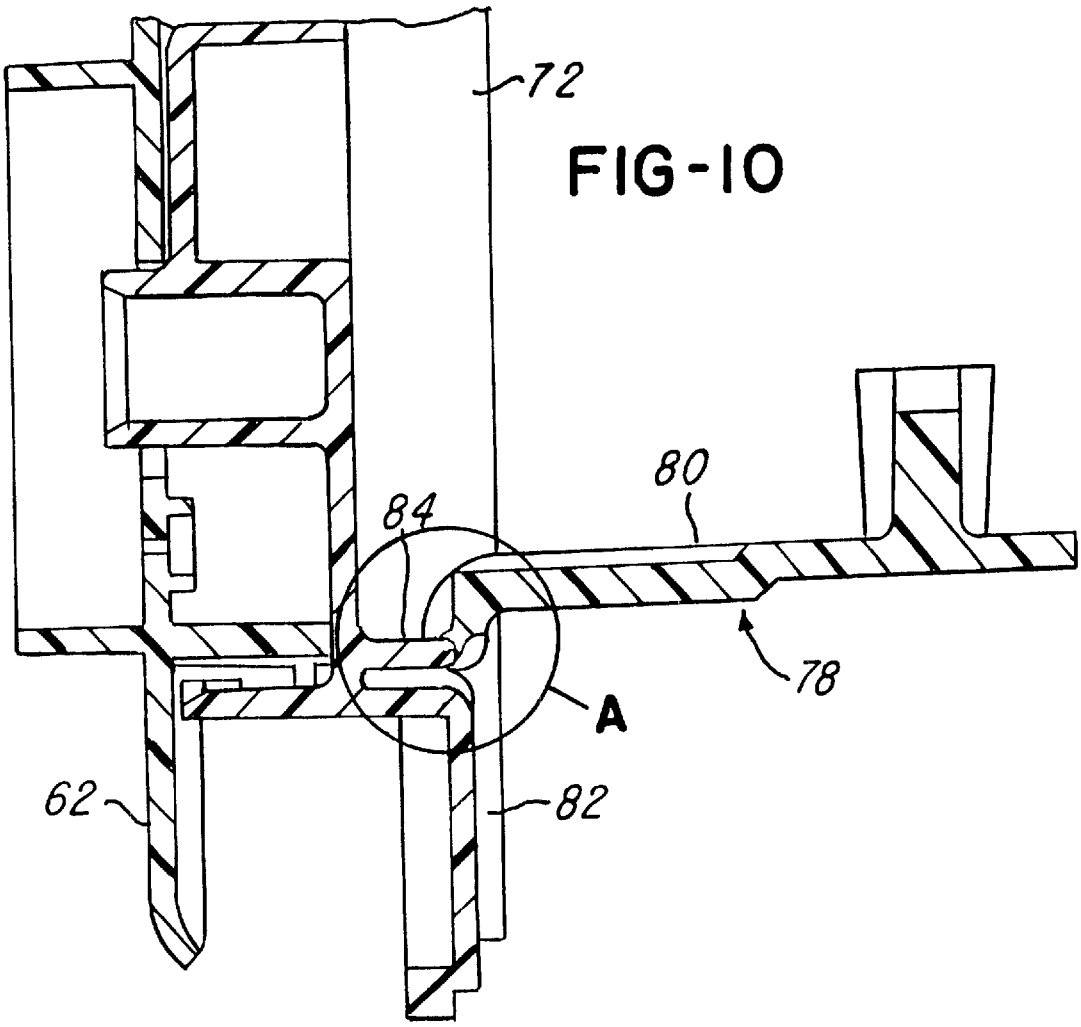
FIG-10
FIG-11
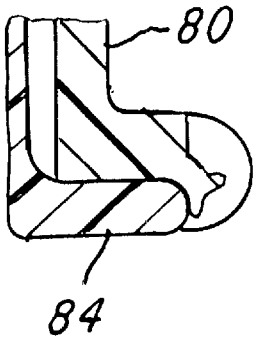
FIG-12
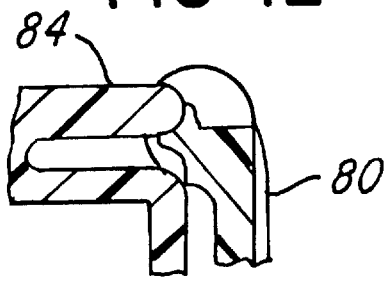

RETRACTABLE CORD ASSEMBLY

FIELD OF THE INVENTION

This invention relates generally to a retractable cord assembly and especially to a retractable assembly for a power cord for an electric appliance. This invention is primarily intended for use in a steam iron but may be used in various other applications.

BRIEF DESCRIPTION OF THE DRAWINGS

FIG. 10 is fragmentary, vertical cross-sectional view of portions of the retractable cord assembly.

FIGS. 11 and 12 are fragmentary, vertical cross-sectional views, on a larger scale than FIG. 10, within the circular section "A" of FIG. 10, and depicting two different positions of a crank used to retract the power cord into the retractable cord assembly.

DETAILED DESCRIPTION

Figure 1:
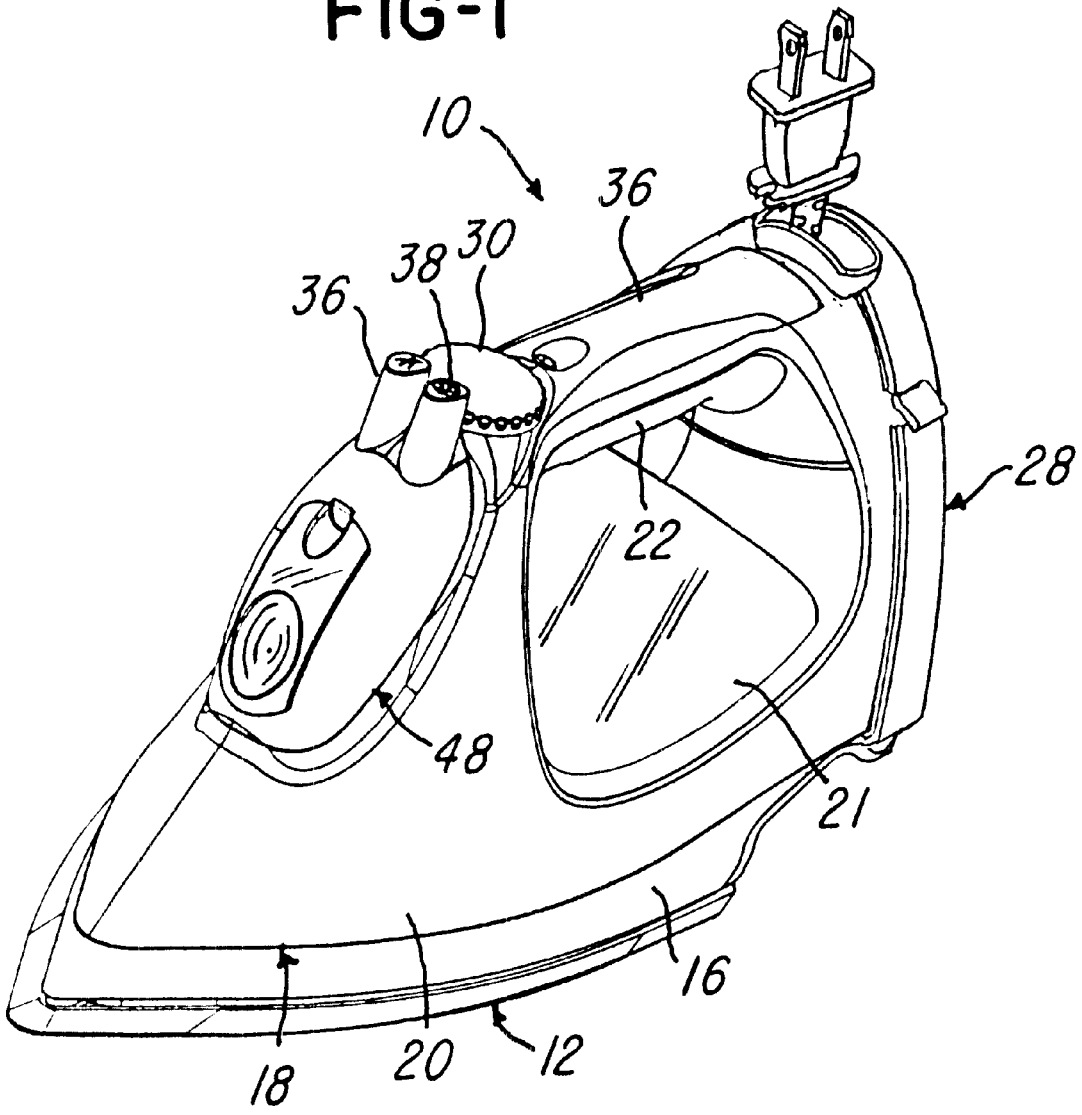
FIG. 1 is a perspective view of a steam iron made in accordance with this invention.
Figure 2:
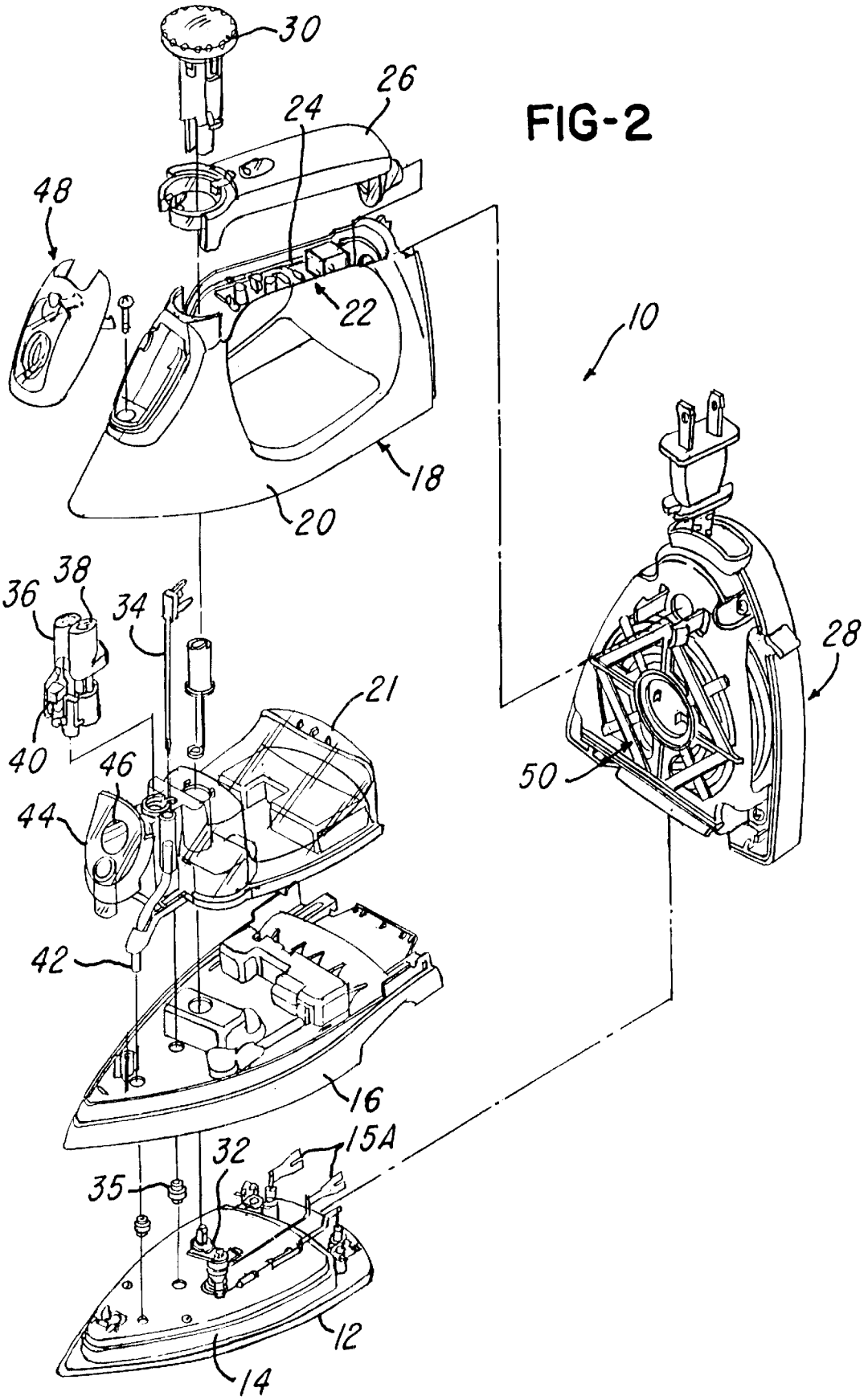
FIG. 2 is an exploded isometric view of the iron of FIG. 1.
Figure 3:
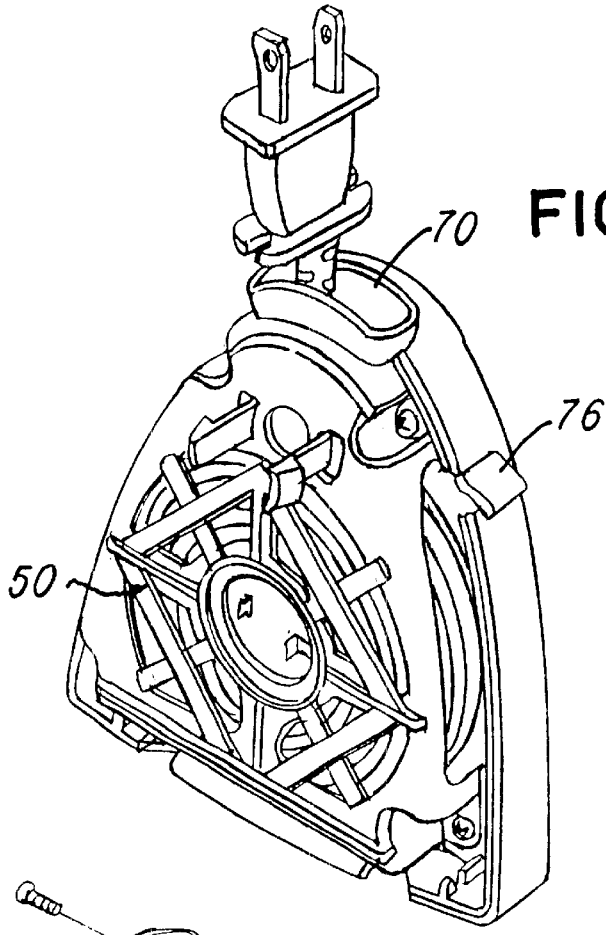
FIG. 3 is an isometric view of the rear cover of the iron of FIGS. 1 and 2, and parts of a retractable cord assembly in accordance with this invention.
Figure 4:
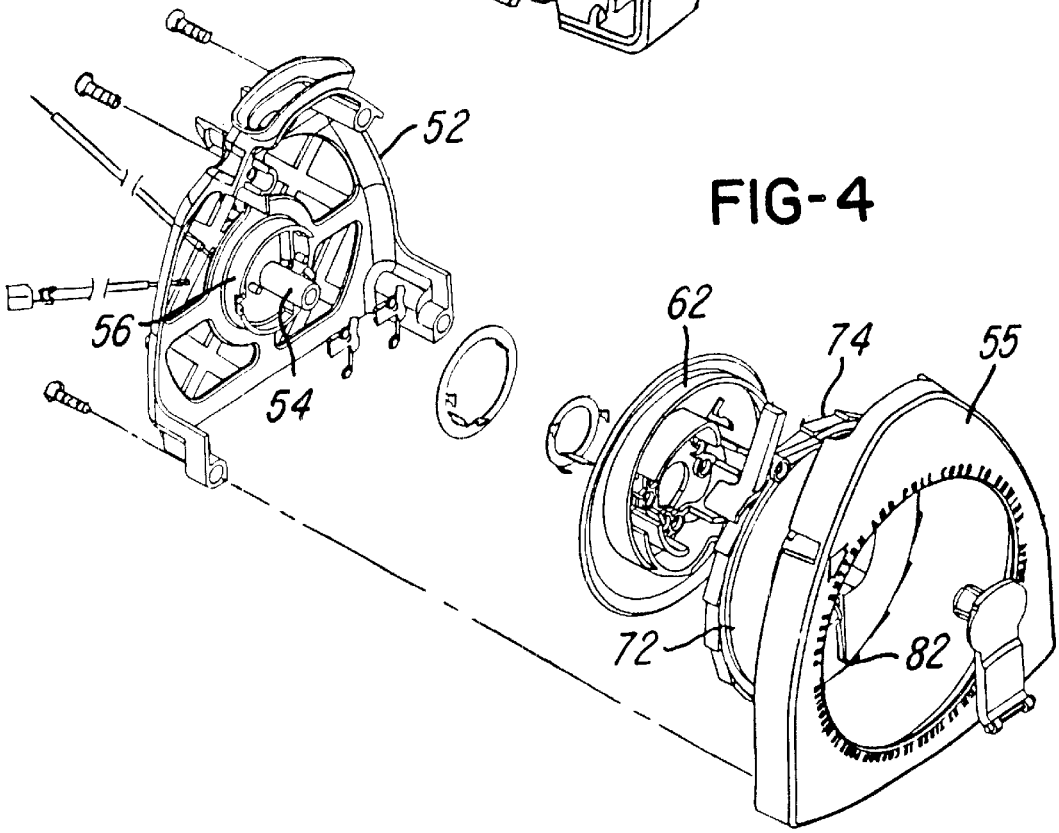
FIG. 4 is an exploded isometric view of the rear cover and the retractable cord assembly of FIG. 3 as viewed generally from the rear of the iron.
Figure 5:
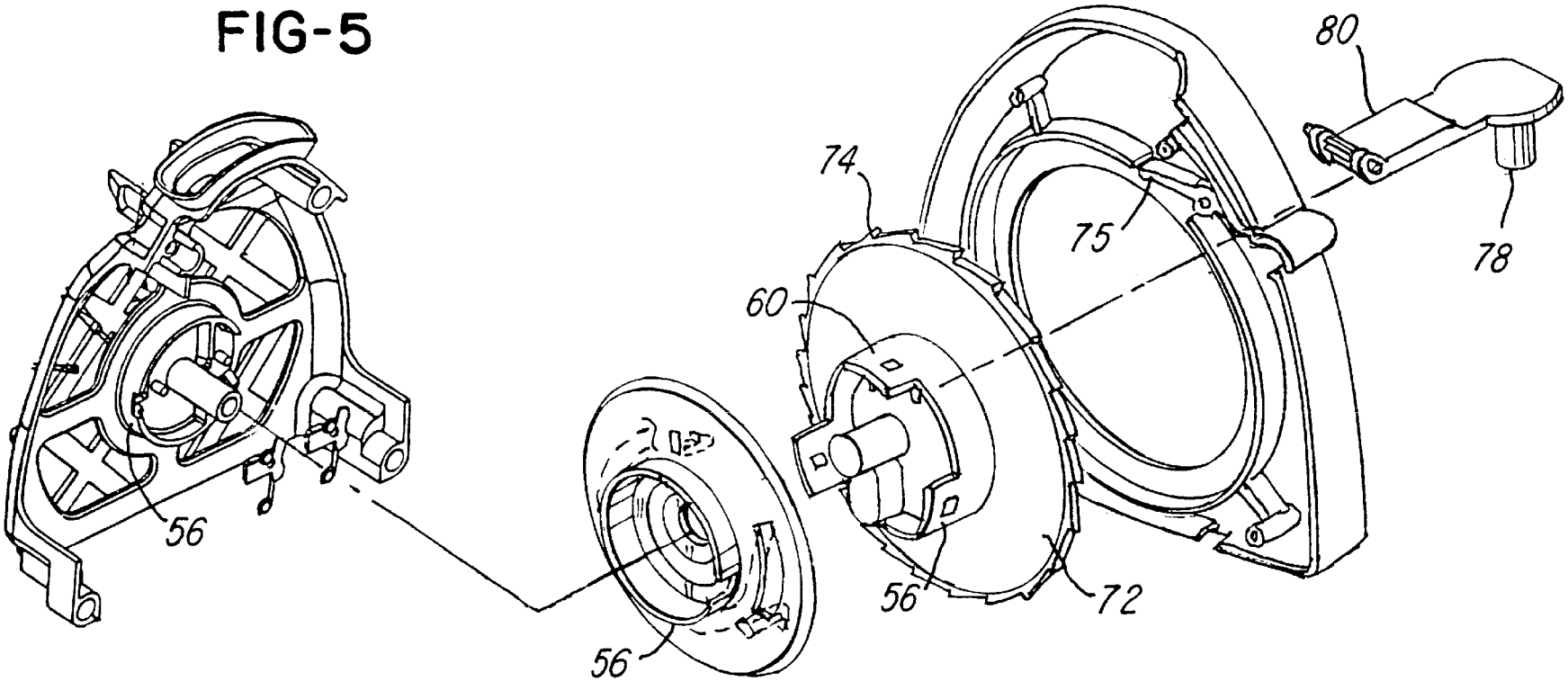
FIG. 5 is an exploded isometric view of the retractable cord assembly as viewed intermediate the front the rear thereof and on a larger scale than FIG. 4.

With reference to FIGS. 1 and 2, the present invention is illustrated in connection with a household steam iron, generally designated 10, having a soleplate 12 with a steam chamber 14, covered by a base cover 16 which supports a handle 18. Handle 18 has a lower portion 20 which confines a water reservoir 21 and an upper portion 22 which receives an electronic control module 24 and which is covered by a top cover 26. The handle upper portion 22 and the top cover 26 constitute a handgrip. In addition, the iron 10 includes a rear cover 28, a temperature control knob 30 for setting a thermostat 32 mounted on the soleplate 12, and a drip valve assembly including a drip valve stem 34 for dripping controlled quantities of water into the steam chamber 14 through a drip valve seal 35. As well known, the water dripped into the steam chamber 14 is heated by a U-shaped electrical heating element (not shown) in the soleplate 12, vaporizes and forms steam which exits from the soleplate 12 through plural steam vents (not shown). Terminals 15A of the heating element and the electronic controls are connected to house current by means of a power cord connected to the rear cover 28. The particular iron 10 shown in the drawings also has a pair of manually-operable pistons 36 and 38, respectively used to spray water forwardly of the iron through a nozzle 40 and to create a burst of steam by pumping water by way of a thermoplastic tube connection 42 into the steam chamber 14. The water reservoir 21 has a forwardly projecting front face 44 and a water conduit 46 extending through the front face 44 into the hollow interior of the reservoir 21. A fill port assembly, generally designated 48, is used to enable one to pour water into the water reservoir 21 and also to cover the water conduit 46 during normal use of the iron to prevent contaminants from entering into the reservoir 21.

Figure 6:
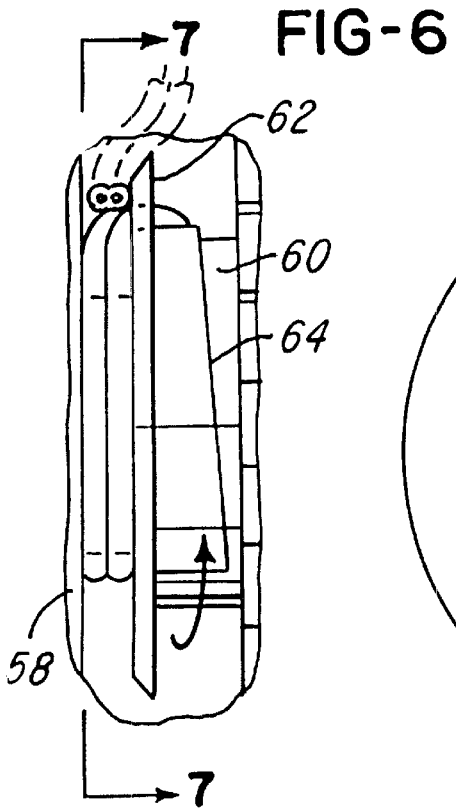
FIG. 6 fragmentary side elevational view of a portion of the retractable cord assembly and illustrating the condition of the parts thereof as the power cord is being taken up by the retractable cord assembly.
Figure 7:
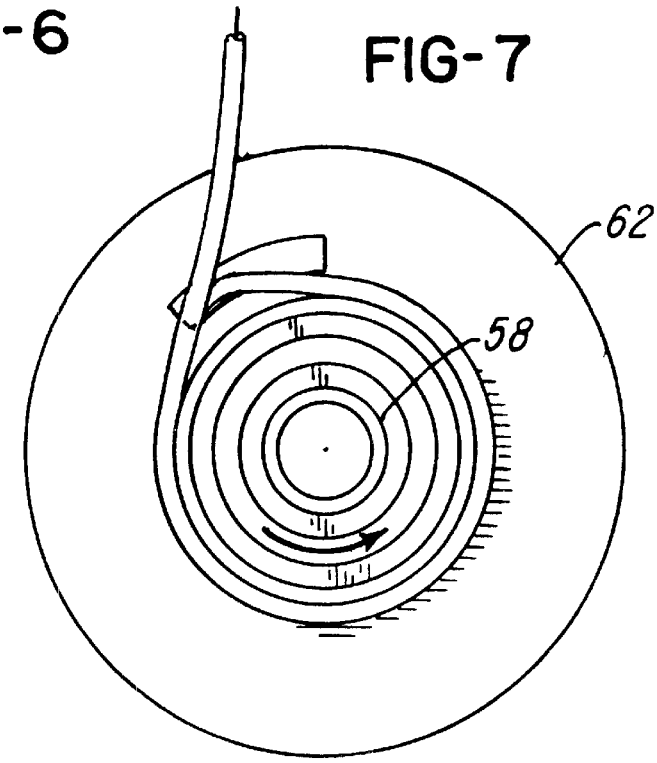
FIG. 7 is a rear elevational view of a portion of the retractable cord assembly as viewed in the direction of arrows 7—7 of FIG. 6.
Figure 8:
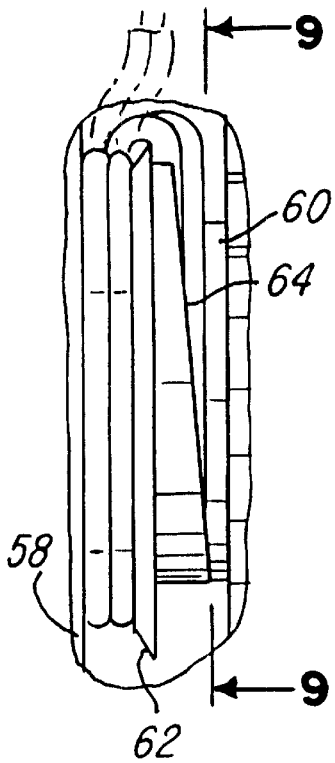
FIG. 8 is a fragmentary side elevational view similar to FIG. 6 but showing the condition of parts after an additional length of the power cord has been taken up.
Figure 9:
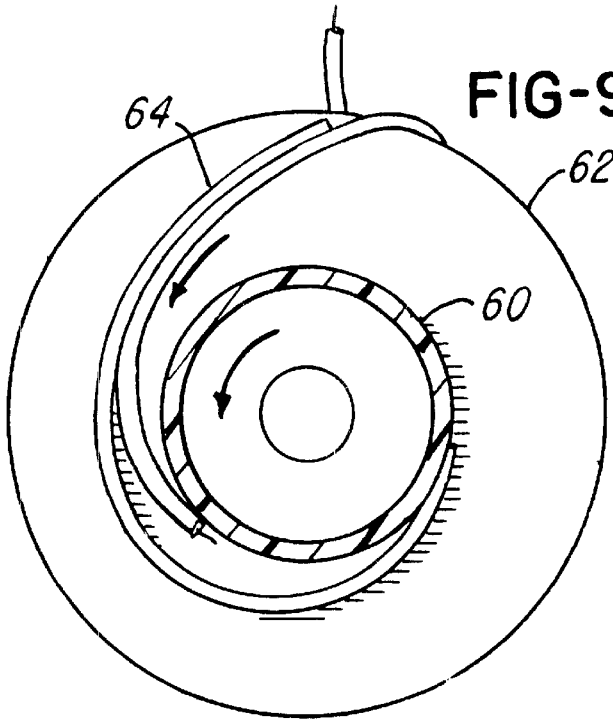
FIG. 9 of a front elevation view of a portion of the retractable cord assembly as viewed in the direction of arrows 9—9 of FIG. 8.

In accordance with this invention, a retractable cord assembly 50 is incorporated into the rear cover 28. The retractable cord assembly comprises a front housing 52 having a rearwardly-extending axle 54, a rear housing 55 fastened to the front housing 52, and a three-part spool 54 for receiving turns of the power cord. The cord assembly 50 has a first cord-receiving cavity section 58 confronting the front plate which is sufficiently narrow that, upon rotation of the spool 56 in a direction to cause the cord to be wound (as indicated by arrows in FIGS. 6, 7 and 9), the winding of turns of the cord is so controlled that each turn of the cord wound in the first section 58 is wound directly over the preceding turn. A second cord-receiving cavity section, designated 60, of the retractable cord assembly is sufficiently wide that, upon continued rotation of the spool in a direction to cause the cord to be wound thereon, the cord can be randomly wound thereon. An intermediate plate 62 separates the narrow first section 58 from the wider second section 60.

The intermediate plate 62 preferably has a cam 64 which cams the first few turns of the cord wound in the second section 60 away from said intermediate plate 62 so that there is initially a partial control of the winding of the cord on the wider second section 60. The provision of both the narrow section and the wider section has proved to enable the winding of a greater length of a power cord on the spool than is possible with only a controlled wind or only a random wind using the same size components.

Further in accordance with this invention, the retractable cord assembly, the front housing 52 has a cord guide window 20 through which the cord passes to the spool 56. The guide window is constructed and arranged to bias the cord toward the wider second section so that, as the level of the turns in the narrower first section increases, the cord is biased to begin winding on the wider second section 60.

The spool is supported in part by a rear plate 72 which is separated from the intermediate plate by the second section of the spool. Plural outwardly-extending ratchet teeth 74 round the circumference of the rear plate 72 cooperate with a pawl 75 supported by said rear housing which is biased into engagement with said ratchet teeth and which has a manually operable pawl release lever 76 for disengaging the pawl from the ratchet teeth to permit the cord to be withdrawn from the spool.

With reference to FIGS. 5 and 10–12, a crank 78 for rotating the spool is pivotally mounted on the rear face of the rear plate 72. Advantageously, the crank 78 has a crank arm 80 and the rear face of said rear plate 72 has a recess 82 that receives the crank arm 80 when the crank arm is used to rotate the spool. The crank is removably mounted on the rear plate 72 and has three points at which it is frictionally held in a position, as illustrated, respectively, in FIGS. 10, 11 and 12, by the engagement of surfaces thereof with a rearwardly extending plate 84 that is integral with the rear plate 72.

Although the presently preferred embodiment of this invention has been described, it will be understood that within the purview of the invention various changes may be made within the scope of the following claims.

Having thus described our invention, we claim:

1. A retractable cord assembly for a cord comprising:

a front housing having a rearwardly-extending axle;

a rear housing fastened to said front housing;

a spool for receiving turns of said cord, said assembly having a first cord-receiving cavity section which is sufficiently narrow that, upon rotation of said spool in a direction to cause the cord to be wound, the winding of turns of the cord is so controlled that each turn of the cord wound in said first section is wound directly over the preceding turn and a second cord-receiving cavity section which is sufficiently wide that, upon continued rotation of said spool in said direction to cause the cord to he wound, the cord enters said second cavity and is randomly wound on said spool in said second cavity, and an intermediate plate separating said first section from said second section.

2. The cord assembly of claim 1 wherein said intermediate plate has a cam which cams the first few turns of the cord wound in said second section away from said intermediate plate.

3. The cord assembly of claim 1 wherein one of said housings has a cord guide window through which the cord passes to said spool.

4. The cord assembly of claim 3 wherein said guide window is constructed and arranged to bias the cord toward said second section.

5. The cord assembly of claim 1 wherein said second section is located between said intermediate plate and a rear plate.

6. The cord assembly of claim 5 wherein said rear plate has plural outwardly-extending ratchet teeth around its circumference;

a pawl supported by said rear housing biased into engagement with said ratchet teeth; and a manually operable pawl release lever for disengaging said pawl from said ratchet teeth.

7. The cord assembly of claim 5 wherein said rear plate has a rear faced exposed at the rear of said retractable cord assembly, and further comprising a crank pivotally mounted on said rear plate for rotating said spool.

8. The cord assembly of claim 7 wherein said crank has a crank arm and the rear face of said rear plate has a recess that receives said crank arm when said crank arm is used to rotate said spool.

9. The cord assembly of claim 8 wherein said crank arm is removably mounted on said rear plate.

10. A steam iron including a handle, a rear cover, a power cord, and a retractable cord assembly, said retractable cord assembly having a manually rotatable, power cord-receiving spool, said assembly having a first, power cord receiving cavity section which is sufficiently narrow that, upon rotation of said spool in a direction to cause the power cord to be wound thereon, the winding of turns of the power cord is so controlled that each turn of the power cord wound in said first section is wound directly over the preceding turn and a second power cord receiving cavity section which is sufficiently wide that, upon continued rotation of said spool in said direction to cause the power cord to be wound on said spool, the power cord enters and is randomly wound in said second cavity, and a plate partly separating said first cavity from said second cavity over which the power cord extends from said first cavity to said second cavity when the power cord is retracted sufficiently to extend from said first cavity into said second cavity.

11. The steam iron of claim 10 wherein said cord assembly is incorporated into the rear cover.

* * * * *